United States Patent [19]

Beerli et al.

[11] Patent Number: 5,022,128

[45] Date of Patent: Jun. 11, 1991

[54] METHOD AND DEVICE FOR YARN DIVISION ON A WARPING MACHINE

[75] Inventors: Markus Beerli, Gossau; Manfred Bollen; Jakob Iten, both of Oberuzwil; Gerhard Koslowski, Uzwil; Willy Probst, Gossau; Edwin Wildi, Niederuzwil, all of Switzerland

[73] Assignee: Benninger AG, Uzwil, Switzerland

[21] Appl. No.: 433,786

[22] Filed: Nov. 9, 1989

[30] Foreign Application Priority Data

Nov. 10, 1988 [CH] Switzerland ..... 4165/88

[51] Int. Cl.[5] ..... D02H 9/02

[52] U.S. Cl. ..... 28/191

[58] Field of Search ..... 28/172, 190, 191, 192, 28/196

[56] References Cited

U.S. PATENT DOCUMENTS

| | | | |
|---|---|---|---|
| 6,342 | 10/1898 | Lanning | 28/172 |
| 4,009,512 | 3/1977 | Baba | 28/191 X |
| 4,765,041 | 8/1988 | Baltzer | 28/191 |

FOREIGN PATENT DOCUMENTS

| | | | |
|---|---|---|---|
| 1535171 | 1/1973 | Fed. Rep. of Germany | 28/191 |

*Primary Examiner*—W. C. Reynolds
*Assistant Examiner*—John J. Calvert
*Attorney, Agent, or Firm*—Shoemaker and Mattare, Ltd.

[57] ABSTRACT

Individual segments (38, 39) are slid over a divided yarn strip (22) with a dividing device (35) and connected together on both sides (63). By this means separate separating elements (23, 29) are formed.

20 Claims, 6 Drawing Sheets

Fig.6a
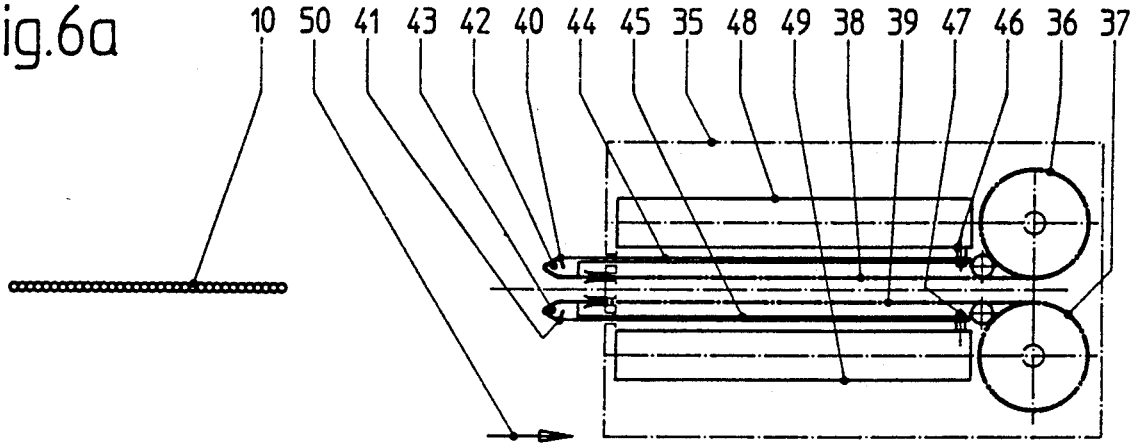
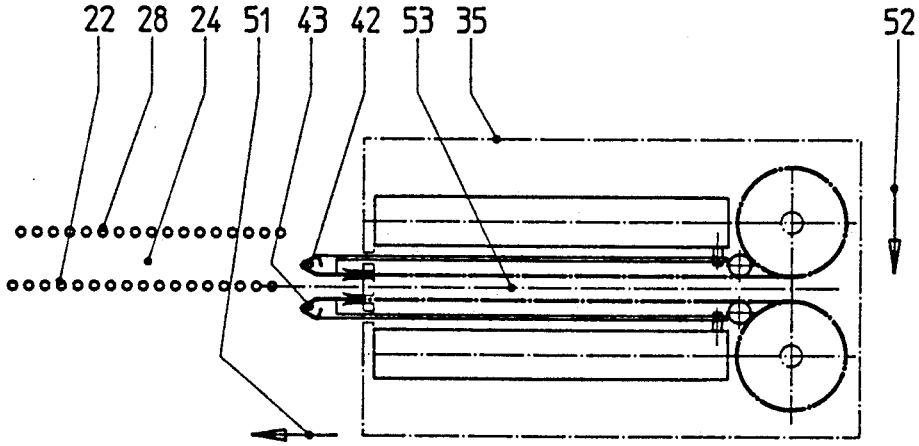
Fig.6b
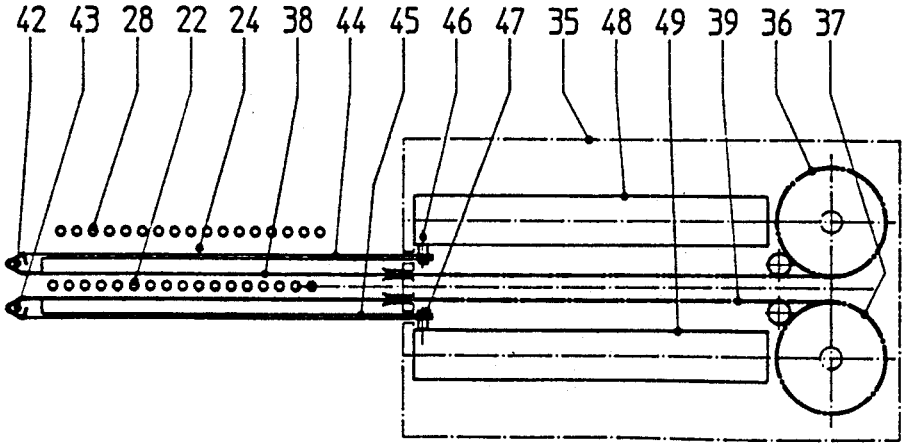
Fig.6c

Fig....6n

METHOD AND DEVICE FOR YARN DIVISION ON A WARPING MACHINE

BACKGROUND OF THE INVENTION

The invention relates to a method and a device for yarn division on a warping machine. A method and a device of this type serve to wind several groups of warp yarns onto the warping drum. The yarn division can additionally serve to create yarn crossings, which later facilitate further working, for example the tieing together of warp yarn ends. When sizing the warp yarns, the yarn division can also ensure that the warp yarns can be guided through the size bath with sufficient separation from one another.

The insertion of separating elements between divided yarn strips is in many cases still carried out manually Methods and devices to carry out this process automatically are known, however. For example, according to CA-A-662 368, a dividing cord is pulled through the consecutively wound up warp strip rows on the drum, with the aid of a steel heald shaft. After each warp strip is completely wound, the steel heald shaft, and with it the attached dividing cord, is pulled further by one warp strip width, with the aid of a special device. The disadvantage of this method is that individual demarkation of the individual strips is not possible because the dividing cord is lead through all the warp strips of the warping drum at the same time A further disadvantage exists, in that with increasing winding radius, the pressure of the windings increases, so that the dividing cord can only be pulled with a large application of force, with the associated risk of yarn damage.

This process is therefore only employed for short warps, where relatively short warp lengths are wound up.

A further automatic method has been made known, for example, through JP-B-62-2055. According to this method two parallel tubes are pushed over the opened yarn strip, whereby the tubes in the engaged position are connected by a firmly fixed tube bend which incorporates a slot in its inner radius. Through either compressed air or a vacuum, a separating yarn is subsequently introduced into one tube, lead around through the tube bend, and back down the other tube, so that a yarn loop can be formed, which is automatically tieable after the two tubes are withdrawn. With this method even individual warp strips can be separated. Naturally, this method is extremely difficult to manipulate, since deflection of the separating yarn through 180 degrees and the formation of the loop is very prone to malfunction.

SUMMARY OF THE INVENTION

It is therefore a purpose of this invention to create a a method in accordance with the introduction, with the help of which the yarn division can be substantially automated with little tendency to malfunction. Additionally the method should not effect the subsequent winding procedure, and there should be no risk to the individual yarns and yarn strips. The yarn dividing procedure should substantially be the equivalent of the established manual procedure without giving rise to sources of malfunction. The device should be easily controllable, and require the least amount of operating and service effort. This task is, according to the invention, fulfilled through a method which has the features recited in the characterizing portion of claims which follow, and a device which has the features recited in the other claims which follow.

The parallel introduction of separate individual segments and their subsequent connection to a compact separating element is considerably easier to achieve than the pulling through or the shooting through of a single separating yarn, with its tendency to malfunction. The individual segments can at the same time possess totally different configurations and qualities, so that also strip shaped and/or relatively stiff materials can be employed. Through the use of different colours for each of the individual segments, optical effects can also be aimed for, so that, for example, twisting of a single warp strip when beaming can be immediately recognized. The separating elements can, related to the position of the warping drum, be introduced into any prefered position, and also different combinations of separating elements can be considered. For example, for the fixing of a yarn crossing, separating elements can be placed on both sides of the crossing line, either only on one or both the divided yarn strips. Through slight width reduction of the divided yarn strips, the connection points of the individual segments can be placed at or within the normal yarn strip width Infringement onto neighbouring warp strips can thus be reliably prevented.

With the aid of the device's rod-type holding elements, both the single individual segments can be effortlessly introduced, also over large warp widths Since introduction occurs without contact with the yarn strips, adhesive or adhering tapes can also be used. The control of the feed or withdrawal movements, either independently or synchronised, is achieved in an especially simple way with the use of a pressure cylinder. A sufficient material supply at each holding element ensures that as many separation procedures as possible can be carried out without servicing being nescessary.

BRIEF DESCRIPTION OF THE DRAWINGS

Further advantages and individual characteristics arise from the following description and from the drawings, wherein

FIG. 6*a* to 6*h* and 6*n* depict the movement sequence for establishment of a yarn crossing according to FIG. 5*a*.

DESCRIPTION OF THE PREFERRED EMBODIMENTS

Figure 1:
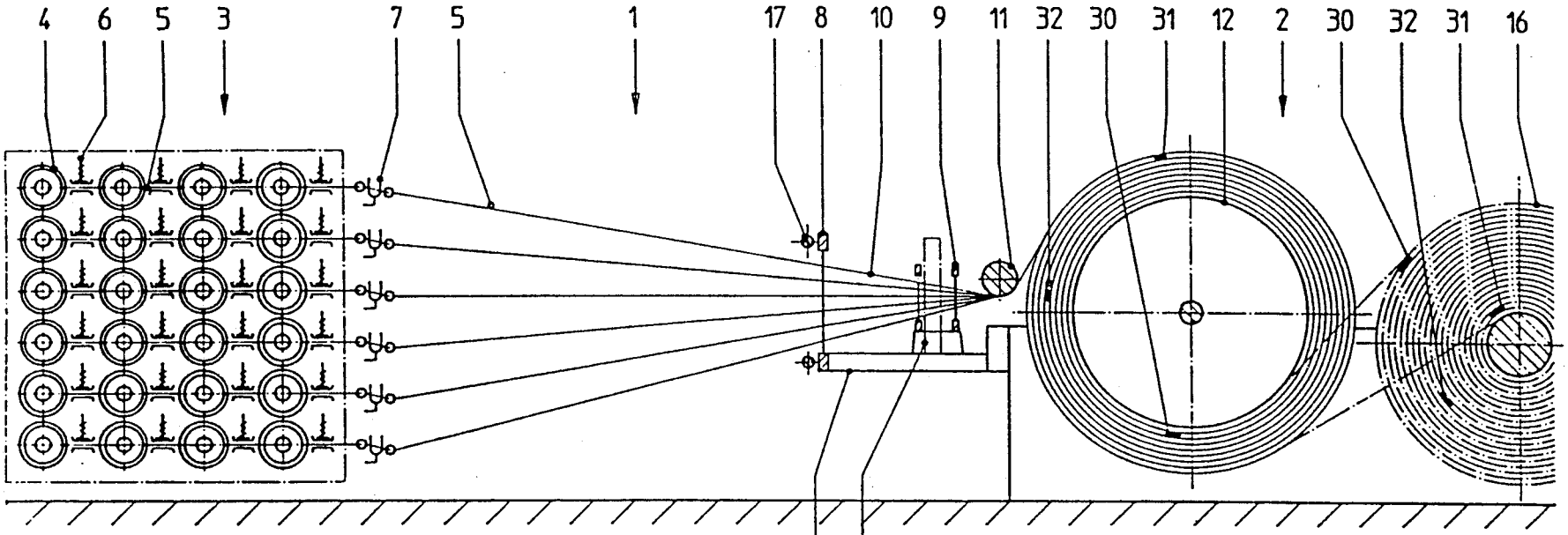
FIG. 1 is a side view of a warping plant, schematically very simplified.

As depicted in FIG. 1, a warping plant consists in principle of a warping machine 2 and a bobbin creel 3. Numerous bobbins 4 are mounted on the bobbin creel 3 the yarns 5 of which all pass a yarn tensioner 6, which produces the required yarn tension. Subsequently each yarn 5 passes a yarn monitor 7, where the presence of the yarn can be checked.

The yarns lead, freely strung, directly from the bobbin creel 3 to the cross reed 8, in which the yarns 5 obtain a definite position and order. Subsequently the yarns lead through the warping reed 9, in which the yarns are brought together at the desired warp strip width, in order to be wound up in this configuration onto the warping drum 12 via a deflection roller 11.

Figure 2:
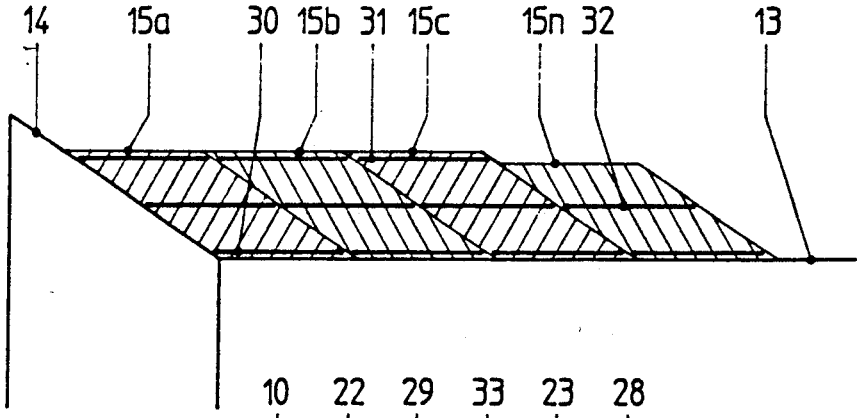
FIG. 2 is a perspective view of a warp strip assembly on a warping drum with separating elements introduced.

From FIG. 2 it is apparent that the warping drum 12, consists of a cylindrical part 13, and a conical part 14. The individual strips 15*a*, 15*b*, etc are not vertically wound up one on top of the other, but displaced horizontally. In this way, slackening of the yarns on the warping drum 12, is prevented.

After winding all strips, 15*a*–15*n*, onto the warping drum 12, they are collectively rewound or beamed from the warping drum 12, onto the warp beam 16.

Figure 5A:
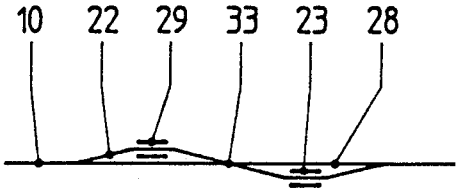
FIGS. 5*a* and 5*b* are side views of a yarn crossing with a separating element on both sides.
Figure 7:
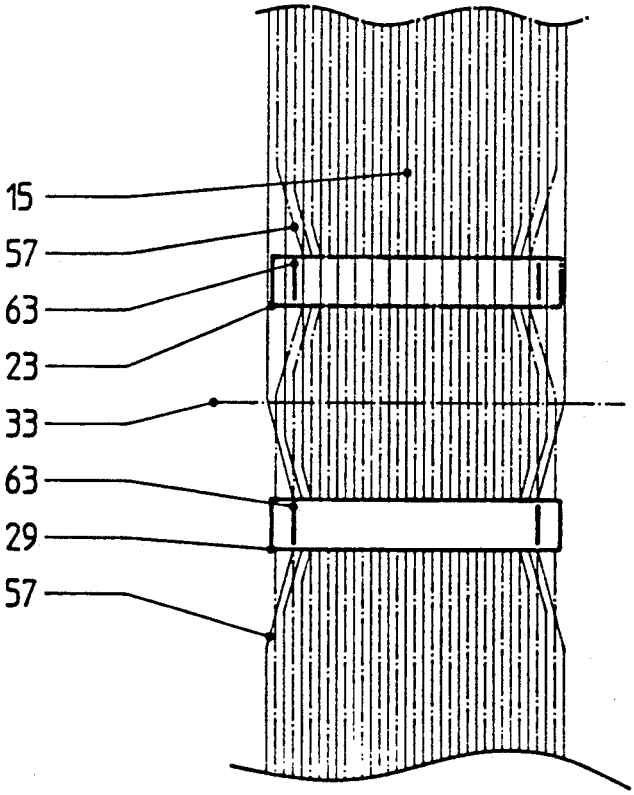
FIG. 7 is a plan view of a yarn crossing on a yarn strip according to 5*a*.
Figure 8:
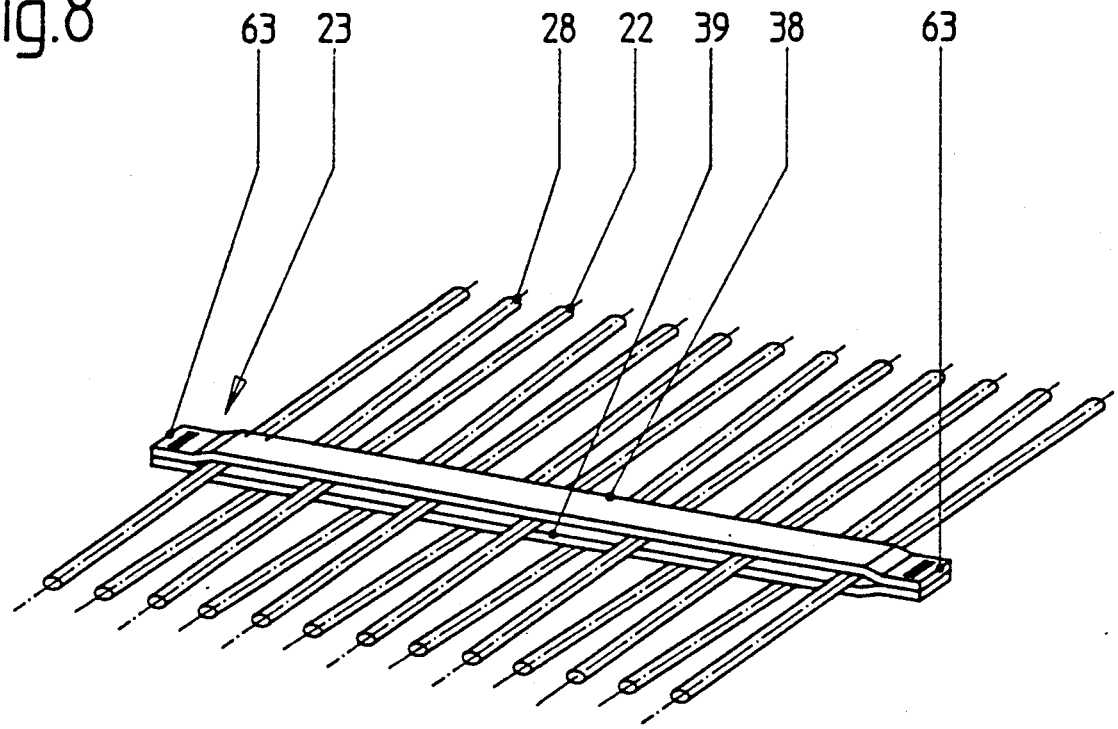
FIG. 8 is a perpective representation of a separating element on a yarn section.

When joining the warps it is evident that the position of the yarns, predetermined by the cross reed 8, must be maintained. For this purpose yarn crossings are created, for separation of the yarns 5, at the start or at the end of the warps, and when necessary between, whose positions are shown in FIGS. 1 and 2, marked 30, 31 and 32. Thus, in relation to the warping drum 12, 30 is a start yarn crossing, 31 is an end yarn crossing, and 32 is an intermediate yarn crossing. As can be seen in FIGS. 5, 7, and 8, the individual yarn crossings 33, are fixed by separating elements 23 and 29, which respectively hold at least one divided yarn strip before and after the yarn crossing 33.

Figure 6G:
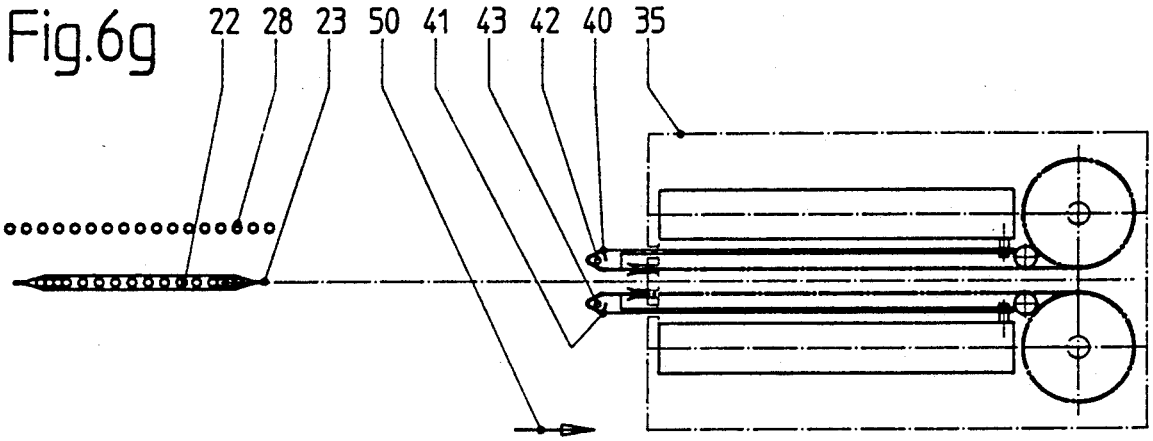

As can be observed in FIG. 8, a single separating element 23 or 29, consists of two separate individual segments, 38 and 39, which are joined at their connection points 63 on each side of the divided yarn strip. With this type of separating element, which is applied to the warp strip, not only the yarn crossings can be fixed. It is also possible to divide up single divided yarn strips for the formation of a sizing division, successively one behind the other, so that the distance between the divided yarns of a single divided yarn strip increases. The formation of a yarn crossing will be described in more detail later, according to FIGS. 3 and 4, as well as FIGS. 6*a*–6*n*.

The introduction of the individual segments 38,39 of a single separating element ensues with the aid, for example, of a dividing device 35, which is arranged to slide on the warping table 34. According to FIGS. 6*a*–6*n*, the device consists of two parallel arranged, slideable, bar-formed holding elements 44 and 45, which are also parallel to the plane of the yarn strips. The holding elements can be extended and withdrawn with the aid, for example, of pneumatic stroke cylinders 48,49, whereby both unsynchronised and synchronised movement is possible. A roller 36 and 37 is allocated to each holding element onto which is wound a large supply of strip material for formation of the individual segments 38 and 39. A clamping device 42,43 is arranged at the end of each holding device 44,45, on which the individual segments can be held fast. In this way the individual segments can be relatively easily introduced into the opened yarn strip, connected together and separated, as will be described later. Naturally the introduction and joining of the individual segments could be achieved in another way. The individual segments could for example be thrown in without the support of the holding element, or instead of a linear movement they could be laterally pivotted in.

The individual segments could, for example, be held fast by a vacuum or another way, instead of a clamping device.

Figure 3:
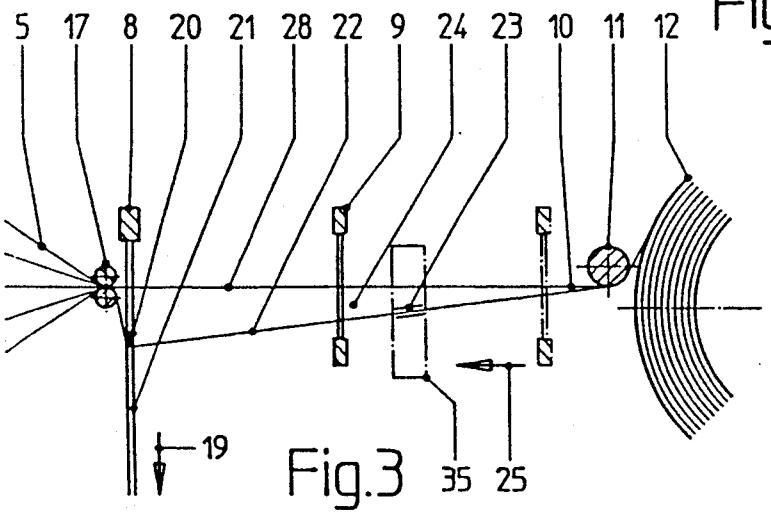
FIG. 3 is an enlarged detail of a portion of FIG. 1, illustrating yarn sheet movement for forming a shed for the introduction of the first separating element.

If a yarn crossing should now be created with the represented device, the following procedure takes place:

The start position is depicted in FIG. 1, whereby yarns 5 are lead from the yarn monitors 7 in the form of a fan to the deflection roller 11. The yarn strip 10 is only formed into an actual warp after it runs onto the deflection roller 11. As depicted in FIG. 3, the yarns 5 must next be brought to one level in front of the cross reed 8 with the aid of the two rods 17. Subsequently the cross reed 8 is moved downwards in the direction of the arrow 19, whereby the upper soldered points 20 attached between every second tooth 21 disengage every second yarn downwards, out of the level 18, so that a divided yarn strip 22 is formed. In this way a shed 24 arises between the parted yarns.

In order to enlarge the shed 24, and with that to facilitate the introduction of the separating element 23, it is appropriate to move the warp reed 9 from its working position in the direction of the arrow 25 towards the cross reed 8 at the same time. The previously described device 35 is moved out of its rest position as depicted in FIG. 6*a* in the direction of the arrow 51 as depicted in FIG. 6*b* into its working position. Thereby the device is at the same time lowered in the direction of the arrow 52 until the central axis 53, between the two-bar formed holding elements, is in approximately the same plane as the disengaged lower yarn divided strip 22.

After assumption of this working position the two pressure cylinders 48 and 49 can be activated, as depicted in FIG. 6*c*, so that the bar-formed holding elements 44 and 45, attached to the bolts 46 and 47, can be inserted over the lower divided yarn strip. Thereby the upper holding element 44 can enter the shed 24 unobstructed. When extending both the holding elements the individual segments 38 and 39 are unwound from the two rollers 36,37. The individual segments are held in front on the clamping devices 42 and 43.

Figure 6H:
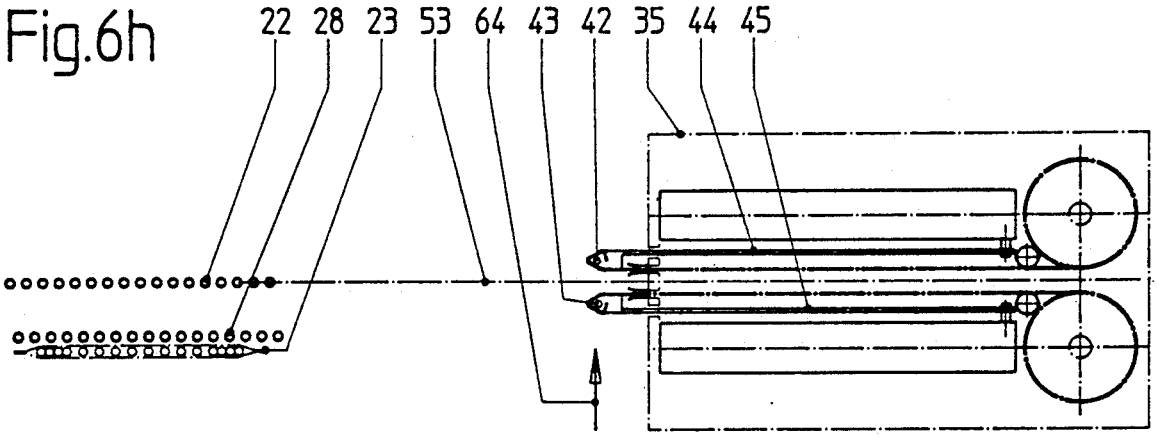
Figure 6H:
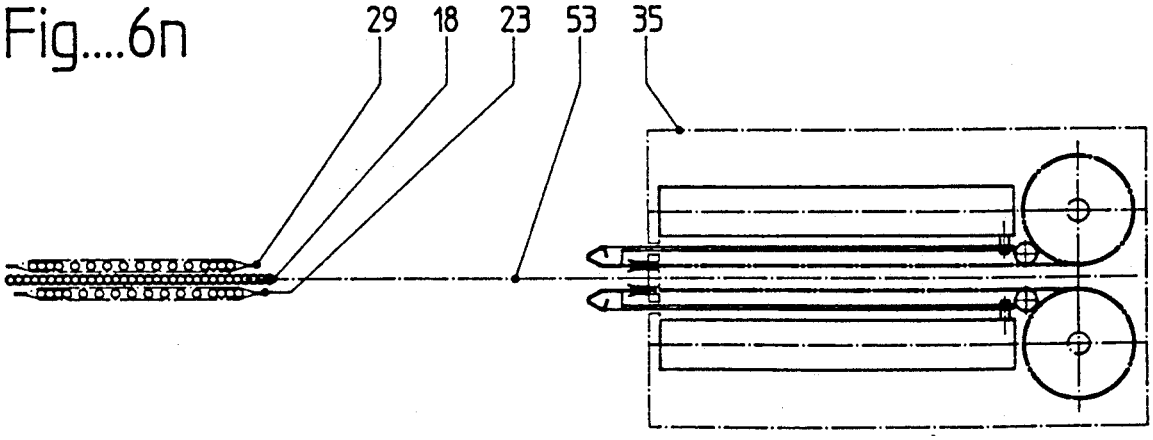
Figure 6D:
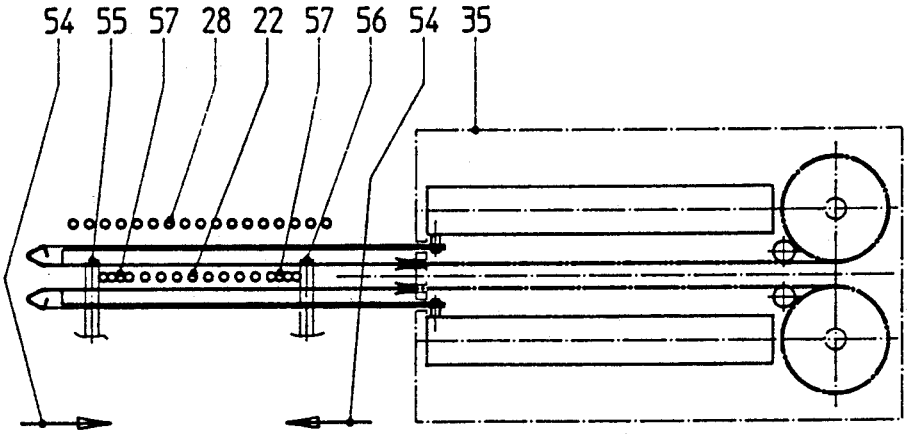
Figure 6E:
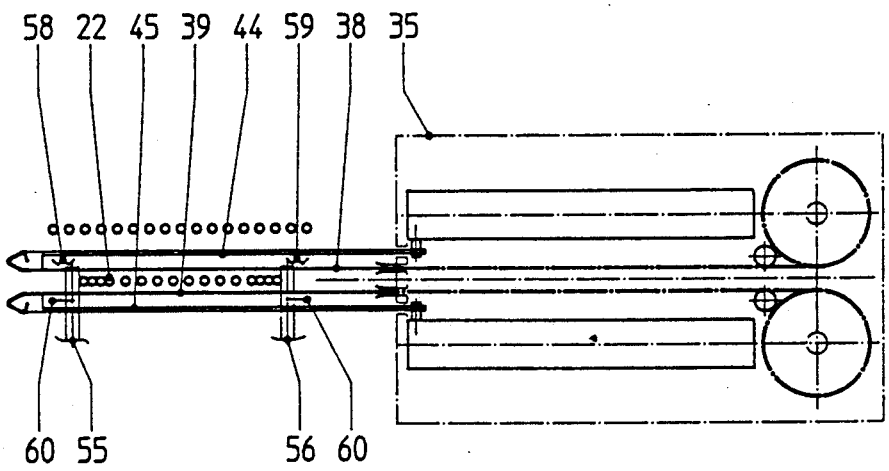
Figure 6F:
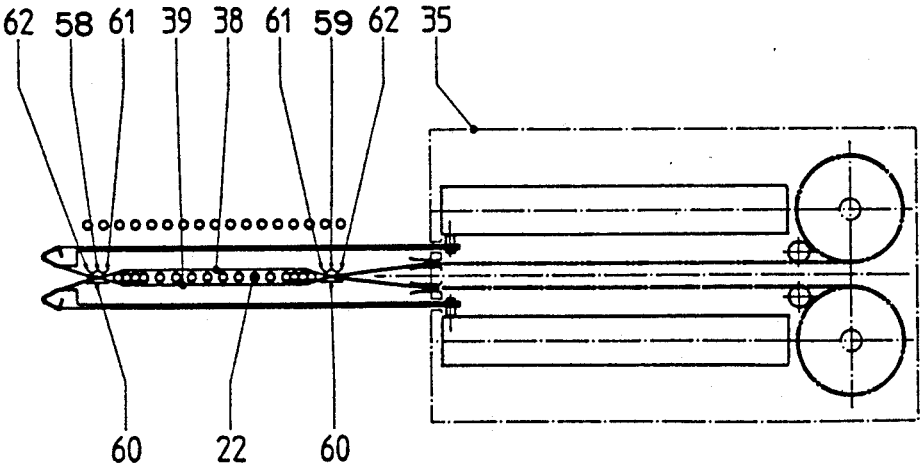

An intermediate step is depicted in FIGS. 6*d* and 6*e*, which facilitates the placement of the separating elements. From beneath, the two pegs 55, 56 are placed at the sides of the lower divided yarn strip 22 and moved towards each other in the direction of the arrows 54. The edge positions 57 of the divided yarn strip are thus pushed together, so that the width of the divided yarn strip 22 is reduced compared to the normal strip width.

After narrowing of the strip width, a connecting and separating cramp 58 and 59, one for each side, is introduced over the upper individual segment 38 , according to FIG. 6*e*. At the same height, but beneath the lower individual segment 39, a connecting and separating table 60, one for each side, is introduced by a means not shown. These connecting and separating tools lie, in their position as related to the warp strip width, within the space made available through the narrowing of the lower divided yarn strip 22.

Subsequently the connecting and separating cramps 58 and 59 are activated, so that both the individual segments 38,39 are connected together on both sides of the divided yarn strip 22. The connection can ensue with the aid of a connecting blade 61, for example, whereby a separating blade 62, located next to it, can at the same time separate the individual segments at their sides to the desired length. After the divided yarn strip is fixed in this way, both pegs 55 and 56 can be spread open and withdrawn, again by a means not detailed. The dividing device 35 can be returned to its basic position, in the direction of the arrow 50, according to FIG. 6*g*. By a means not shown in detail, the remains of the separated individual segments are removed and once again new starts 40 and 41 for the upper and lower individual segments can be fed into the clamping devices 42, 43. The dividing device 35 is now ready to create the second separating element.

Figure 4:
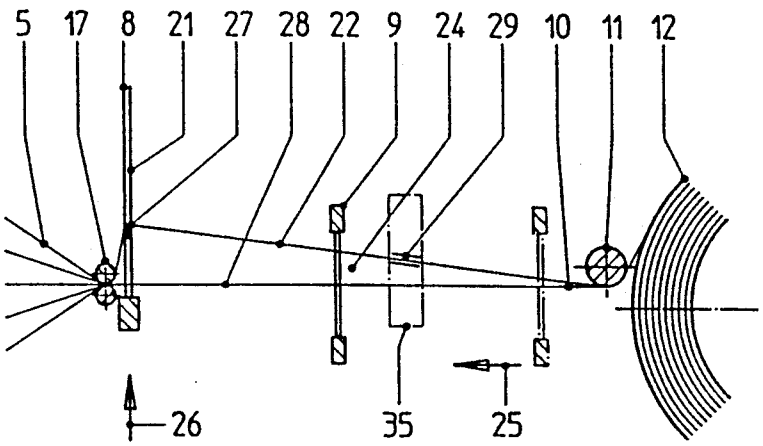
FIG. 4 is a view corresponding to FIG. 3, showing yarn sheet movement for forming a shed for the the introduction of the first separating element.

The introduction of the second separating element 29 is depicted in FIG. 4. Here the warping plant 1 must be moved a few centimeters further in creep motion, after which it is stopped once again. Subsequently the cross reed 8 is disengaged upwards, in the direction of the arrow 26, whereby the divided yarn strip 22 is disengaged upwards by the lower soldered points 27, and thus a shed 24 is formed once again. The second divided yarn strip 28 remains as before in the plane 18, held by both the rods 17.

According to FIG. 6*h*, the dividing device 35 travels now in the direction of the arrow 64, so that the central axis 53 lies approximately in the same plane as the upwardly disengaged divided yarn strip 22. For the sake of clarity, the first separating element 23, already transported onto the warping drum 12 in the direction of yarn movement, is illustrated. In reality the yarns in the divided yarn strip 22, held together by separating element 23, cross the second divided yarn strip 28 and move upwards to the level depicted in FIG. 6*h*.

The second separating element 29 is now introduced in the same way, although the steps are not depicted here, and fastened as with the first separating element 23, so that both the separating elements 23 and 29 lie below and above the other divided yarn strip 28, or the plane 18 as depicted in FIG. 6*n*. In the region of the yarn crossing both the divided yarn strips 22 and 28 lie immediately next to each other, so that the representation in FIG. 6*n*results in practice. The yarn crossing 33, produced as described, is represented symbolically in FIG. 5*a*.

The horizontal position of the separating elements 23 and 29 can be observed from the plan view of the yarn crossing according to FIG. 7. The connecting points 63 between the individual segments are located within the yarn strip width, and the total width of the separating elements is about the same as the warp strip width. Through this it is ensured that the warp strips 15*a*–15*n*, lying together on the warping drum 12, do not interfere with the winding build-up, as can be observed in FIG. 2. The separating elements for the separate strips always lie at the same level during yarn crossing formation, indeed in relation to their angle position as well as their diameter position. When forming a sizing division, numerous separating elements can naturally be placed on one warp strip, displaced one behind the other.

Figure 5B:
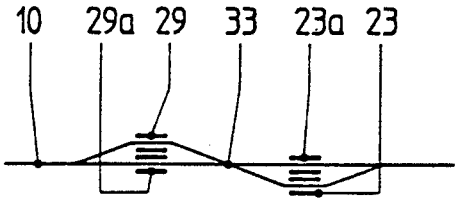

As can be observed in FIG. 5*b*, the yarn crossing formation can so ensue, that a separating element can be placed on both divided yarn strips 22 and 28, one on each side of the yarn crossing. The dividing device 35 could be thus so adapted that both the vertically adjacent separating elements can be introduced and located at the same time.

The individual segments for formation of the separating elements can be formed from completely different materials such as plastic, textiles, metal foils etc. Accordingly there are numerous possibilities to consider for joining the two individual segments. In certain cases it can be of special significance that the separating elements are arranged to slide on the divided yarn strips. In other cases it can be desireable, however, that both individual segments fix each individual yarn of the divided yarn strip, which, for example, could be conceivable with the aid of an adhesive tape.

We claim:

1. Method of maintaining yarn division established by a cross reed on a warping machine comprising inserting a flexible separating element, for demarkation of divided yarn strips, between the yarn strips opened to form a shed, wherein the flexible separating element comprises two parallel individual segments and is inserted over one divided strip into the shed, and subsequently joining the segments together on outside edges of the divided yarn strip.

2. Method according to claim 1 wherein respective separating elements (23,29), for the formation of a yarn crossing, are arranged consecutively before and after the yarn crossing each separating element fixing one divided yarn strip and separating it from another divided yarn strip.

3. Method according to claim 1, wherein an additional separating element is arranged yarn crossing consecutively before and after on each divided yarn strip.

4. Method according to one of claims 1, 2, or 3, wherein the individual segments are inserted laterally into the divided yarn strip with inserting elements and separated as required in the divided yarn strip.

5. Method according to claim 4, wherein the inserting elements are inserted into the divided yarn strip concurrently, or chronologically displaced.

6. Method according to one of the claims 1, 2 or 3, wherein the divided yarn strips width, gripped by the separating element, is reduced and placed on or within the original divided yarn strip width of the divided yarn strip and wound up onto a warping drum.

7. Method according to one of the claims 1, 2 or 3 wherein each of the parallel individual segment is wound off a separate roller (36,37).

8. Method according to claim 1, 2 or 3, wherein the separating element comprises a plastic strip.

9. Method according to claim 1, 2 or 3, wherein the separating element comprises an adhesive tape.

10. Method according to claim 1, 2 or 3, wherein the separating element comprises an adhering tape.

11. Method according to claim 1, 2 or 3, wherein the separating element comprises individual segments of different colours.

12. Method according to any one of the claims 1, 2 or 3 wherein the individual segments are welded together.

13. Method according to any one of the claims 1, 2 or 3 wherein the individual segments are glued together.

14. Method according to any one of the claims 1, 2 or 3 wherein the individual segments are rivetted, clamped or pressed together.

15. Method according to any one of the claims 1, 2 or 3 wherein the cross reed is moved in an approximately vertical direction to form the shed between the divided yarn strips, that the warping reed is moved in the direction of the cross reed, and that the individual segments are introduced between a warping reed and a warping drum.

16. Apparatus for yarn separating in a warping machine, with at least one inserting element to inset a flexible separating element, comprising two individual segments, between yarns of a yarn strip opened to form a shed, said device including rod type holding elements placed apart from one another, and slidable in parallel, and clamping means on each end of the holding elements for gripping an individual segments of the separating element, and two connecting devices, to join both the individual segments, arranged at a distance from one another on either side of the yarn strips by each holding element.

17. Apparatus according to claim 16, wherein holding elements are activated pneumatically, hydraulically or electrically.

18. Apparatus according to claim 16 or 17, wherein each holding element is provided with an attached supply magazine for single or connected individual segments.

19. Apparatus according to one of the claims 16 or 17, wherein further comprising a width reducing element placed on each side of the yarn strip, whereby both width reducing devices can be put against the yarn strip which is to be equipped with the separation element, and are moveable towards one another to reduce the yarn strip width.

20. Apparatus according to claim 16 or 17, wherein the yarn separating device is arranged to slide in relation to the yarn strip.

* * * * *